US008525757B2

(12) United States Patent
Nishi et al.

(10) Patent No.: US 8,525,757 B2
(45) Date of Patent: Sep. 3, 2013

(54) DISPLAY DEVICE THAT REPAIRS DEFECTIVE LIGHT EMITTING ELEMENTS AND METHOD OF DRIVING THE SAME

(75) Inventors: Yuji Nishi, Kanagawa (JP); Takehiro Misonou, Kanagawa (JP)

(73) Assignee: Sony Corporation, Tokyo (JP)

( * ) Notice: Subject to any disclaimer, the term of this patent is extended or adjusted under 35 U.S.C. 154(b) by 787 days.

(21) Appl. No.: 12/547,947

(22) Filed: Aug. 26, 2009

(65) Prior Publication Data

US 2010/0053040 A1 Mar. 4, 2010

(30) Foreign Application Priority Data

Aug. 27, 2008 (JP) ..... 2008-217520

(51) Int. Cl.
*G09G 3/30* (2006.01)

(52) U.S. Cl.
USPC ..... 345/76; 345/77

(58) Field of Classification Search
USPC ..... 345/76
See application file for complete search history.

(56) References Cited

U.S. PATENT DOCUMENTS

| | | | | |
|---|---|---|---|---|
| 7,095,883 | B2 | 8/2006 | Safaee-Rad et al. | |
| 2003/0142047 | A1* | 7/2003 | Inoue et al. | 345/82 |
| 2004/0004692 | A1* | 1/2004 | Hiroki | 349/192 |
| 2004/0189556 | A1* | 9/2004 | Tsujino et al. | 345/82 |
| 2004/0263442 | A1* | 12/2004 | Shingai et al. | 345/76 |
| 2006/0007220 | A1* | 1/2006 | Perner | 345/207 |
| 2006/0007249 | A1* | 1/2006 | Reddy et al. | 345/690 |
| 2006/0012311 | A1* | 1/2006 | Ogawa | 315/169.3 |
| 2008/0266216 | A1* | 10/2008 | Choi | 345/77 |

FOREIGN PATENT DOCUMENTS

| | | |
|---|---|---|
| JP | 2000-347626 | 12/2000 |
| JP | 2003262842 | 9/2003 |
| JP | 2004-012256 | 1/2004 |
| JP | 2004-534949 | 11/2004 |
| JP | 2005274821 | 6/2006 |
| JP | 2006-323032 | 11/2006 |
| JP | 2007-047777 | 2/2007 |
| JP | 2007212943 | 8/2007 |
| JP | 2008-191238 | 8/2008 |

OTHER PUBLICATIONS

Japanese Office Action for corresponding JP2008-217520 issued on Jun. 23, 2010.

* cited by examiner

*Primary Examiner* — Chanh Nguyen
*Assistant Examiner* — Long D Pham
(74) *Attorney, Agent, or Firm* — K&L Gates LLP

(57) ABSTRACT

A display device includes: horizontal scan lines; vertical scan lines; an electro-optical element disposed at each of positions where the horizontal scan lines and the vertical scan lines intersect and selectively turned on based on a video signal and a vertical scan signal; a defect information storing section that stores defect information indicating whether each of the electro-optical elements has a defect; and a video signal generating section that generates a video signal to be supplied to the electro-optical element in each position based on a video signal supplied from outside and the defect information, wherein the video signal generating section supplies a video signal to the electro-optical elements such that the supply of a level required for turning on an element is stopped for an electro-optical element having a defect and the video signal supplied from the outside is supplied to an electro-optical element having no defect.

12 Claims, 3 Drawing Sheets

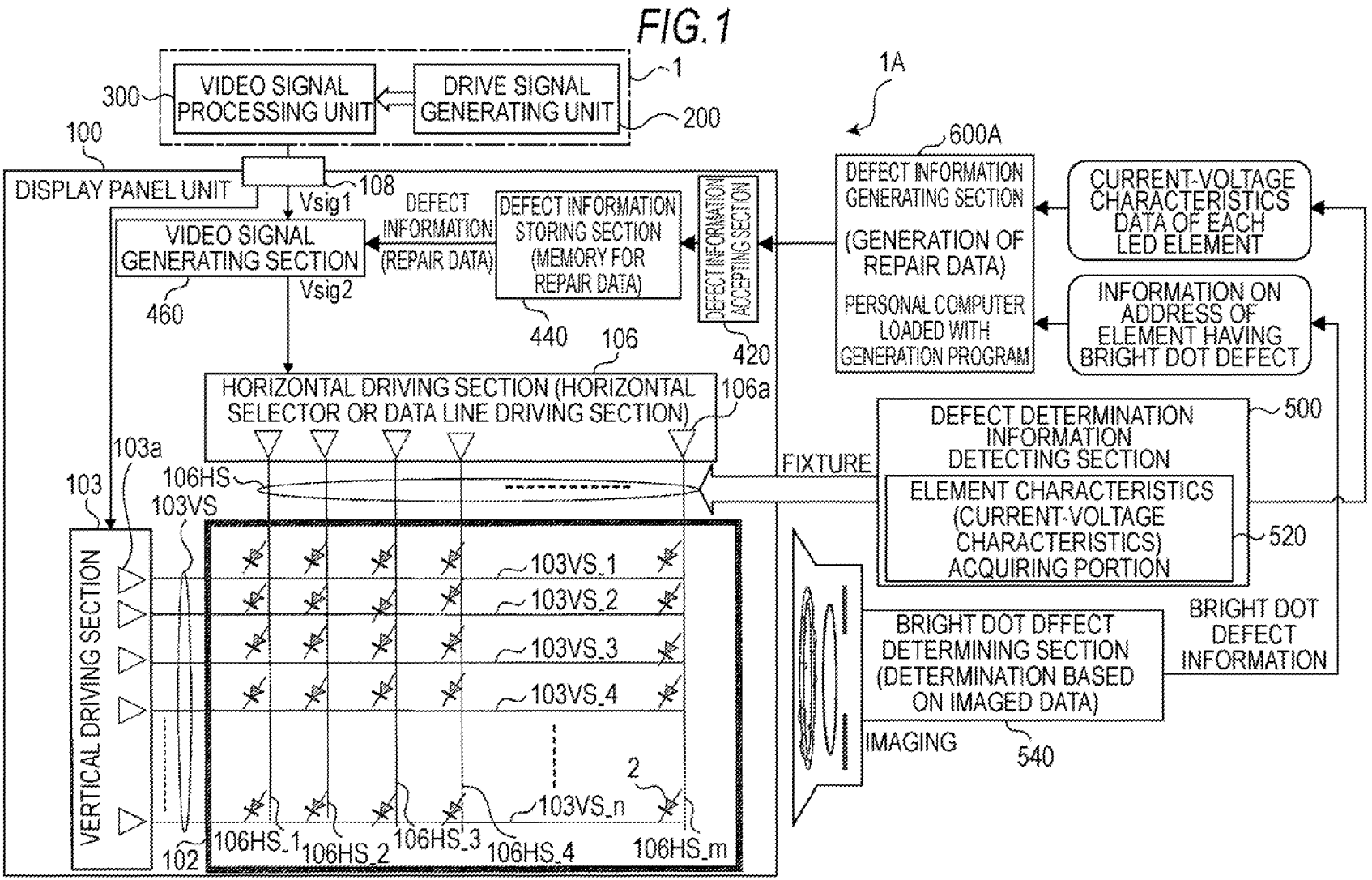
FIG. 1
1A
1
200
300
100
600A
DRIVE SIGNAL GENERATING UNIT
VIDEO SIGNAL PROCESSING UNIT
DISPLAY PANEL UNIT
DEFECT INFORMATION GENERATING SECTION
(GENERATION OF REPAIR DATA)
PERSONAL COMPUTER LOADED WITH GENERATION PROGRAM
CURRENT-VOLTAGE CHARACTERISTICS DATA OF EACH LED ELEMENT
INFORMATION ON ADDRESS OF ELEMENT HAVING BRIGHT DOT DEFECT
500
DEFECT DETERMINATION INFORMATION DETECTING SECTION
520
ELEMENT CHARACTERISTICS (CURRENT-VOLTAGE CHARACTERISTICS) ACQUIRING PORTION
BRIGHT DOT DEFECT INFORMATION
BRIGHT DOT DEFECT DETERMINING SECTION (DETERMINATION BASED ON IMAGED DATA)
540
IMAGING
FIXTURE
DEFECT INFORMATION ACCEPTING SECTION
420
DEFECT INFORMATION STORING SECTION (MEMORY FOR REPAIR DATA)
440
DEFECT INFORMATION (REPAIR DATA)
108
Vsig1
Vsig2
VIDEO SIGNAL GENERATING SECTION
460
106
HORIZONTAL DRIVING SECTION (HORIZONTAL SELECTOR OR DATA LINE DRIVING SECTION)
106a
106HS
103VS
103a
103
VERTICAL DRIVING SECTION
102
2
103VS_1
103VS_2
103VS_3
103VS_4
103VS_n
106HS_1
106HS_2
106HS_3
106HS_4
106HS_m

DISPLAY DEVICE THAT REPAIRS DEFECTIVE LIGHT EMITTING ELEMENTS AND METHOD OF DRIVING THE SAME

CROSS REFERENCES TO RELATED APPLICATIONS

The present application claims priority to Japanese Priority Patent Application JP 2008-217520 filed in the Japan Patent Office on Aug. 27, 2008, the entire contents of which is hereby incorporated by reference.

BACKGROUND

The present application relates to a display device and a method of driving the same and, more particularly, to a technique for driving a defective element (measures for repairing the same in practice).

Various types of electronic apparatus include display devices which utilize electro-optical elements having brightness changing with a voltage applied thereto or a current passed therethrough as pixel displaying elements. For example, liquid crystal display elements are typical electro-optical elements having brightness changing with a voltage applied thereto. Typical examples of electro-optical elements having brightness changing with a current passed therethrough include common LEDs (light emitting diodes) and organic electro luminescence elements and organic light emitting diodes (OLEDs) which will be hereinafter collectively referred to as organic EL elements. Display devices utilizing the latter elements, i.e., common LEDs or organic EL elements, are so-called self-emitting display devices which utilize self-emitting electro-optical elements as a display element of a pixel.

An electro-optical element is made to emit light as follows. For example, in the case of an active matrix type element, an input image signal supplied through a video signal line is stored in a holding capacity (which may alternatively be called a pixel capacity) provided at a gate end (control input terminal) of a driving transistor using, for example, a switching transistor (which may be called a sampling transistor), and a drive signal is supplied to the electro-optical element according to the stored input image signal. In the case of a passive matrix type element, an electro-optical element is disposed in an intersection between a column scan line and a row scan line, and the electro-optical element is driven by drive signals supplied to the column scan line and the row scan line.

In a liquid crystal display device utilizing liquid crystal display elements as electro-optical elements, since the liquid crystal display elements are voltage-driven elements, a voltage signal according to an input image signal stored in a holding capacity is used as it is to drive a liquid crystal display element. On the contrary, in an organic EL display device utilizing current-driven elements such as organic EL elements as electro-optical elements, a drive signal (voltage signal) according to an input image signal stored in a holding capacity is converted into a current signal using a drive transistor, and the drive current is supplied to an organic EL element or the like.

However, an electro-optical element may become an improperly emitting pixel for some cause associated with the manufacture of the panel or the way the panel is used after shipment. Thus, panels may have defective elements which can reduce the yield of the panels. Such display defects constitute a factor hindering the improvement of the non-defect ratio of display devices, and a cost reduction of the display devices is consequently hindered. Defects can also occur after the shipment of a product, and the display quality of the product is degraded.

A defective state of an electro-optical element appears in the form of an unlit dot (a dark dot or non-emitting pixel), a bright dot (a pixel emitting with high brightness out of a normal range), or a dot emitting at an insufficient level of emission out of the normal range depending on the type of the element (for example, depending on whether the element is a liquid crystal display element or an LED element which may be an organic EL element) or depending on the type of the defect, e.g., depending on whether the defect is a short circuit defect, an open circuit defect, or an insufficient state of driving.

Under the circumstance, some approaches are taken to cope with defects of a display device used in an electronic apparatus by inspecting each of pixels arranged on a display panel to find any defective state (see JP-A-2003-262842 (Patent Document 1) and JP-A-2005-274821 (Patent Document 2)).

For example, Patent Document 1 discloses the use of a method in which a defective element of a display panel is repaired by reworking the panel directly. Specifically, a bright dot defect of a liquid crystal display device is corrected using a repair method in which the defective element is irradiated with a laser beam to rework an alignment film thereof such that the liquid crystal aligning performance of the film will be moderated to reduce the quantity of transmitted light.

Patent Document 2 addresses light-emitting display panels in which a multiplicity of pixels each including a self-emitting element having diode characteristics are arranged in the form of a matrix at intersections between scan lines and data lines and in which each of the self-emitting elements is selectively driven for emission. According to the technique, any problem in each self-emitting element of a light emitting display panel is detected, and detection results are stored in storage means. Locations having a problem (defect) are thus identified, and defect notification means is activated accordingly. Thus, a user can be quickly notified of the presence of a defective element.

The approach disclosed in Patent Document 1 has a risk of a new defect attributable to the use of a laser beam, and concern exits also about a possible cost increase attributable to a great amount of man-hour required for the rework. Let us assume that an element, electrode, or wiring of a display panel having electrodes formed by a matrix of self-emitting electro-optical elements such as LEDs is broken using a laser beam according to the method. Although a bright dot defect can be surely turned into a dark dot, another problem arises because the element now has an open circuit failure. Specifically, when the element has an open circuit failure, a current instantaneously flows through other elements connected in the same row in an amount equivalent to a floating capacity that those elements have. Thus, those elements may emit light at unwanted timing depending on the value of the current. After the floating capacity is charged with the current, a voltage increase approaching the circuit voltage of a current output circuit occurs, and the risk of application of an overvoltage therefore arises.

According to Patent Document 2, when a pixel has a defect, a user is notified of the defective state to prevent wrong display information from being conveyed to the user. Although the document addresses anti-defect measures, no measure against a defective element itself is disclosed.

SUMMARY

Under the above-described circumstance, it is desirable to provide a mechanism which allows the non defect ratio of display devices to be improved without using the repair method involving reworking such as the use of a laser beam. In particular, it is desirable to allow a repair process on a defective element emitting light out of a normal range to be conducted through an electrical approach.

Further, it is more desirable to provide an approach which eliminates the problem caused by supplying a driving signal to a defective element.

According to an embodiment, it is determined whether there is a defect or not at each of electro-optical elements of a display panel unit having horizontal scan lines disposed in parallel in the column direction of a matrix to supply a video signal, vertical scan lines disposed in parallel in the row direction of the matrix to supply a vertical scan signal, an electro-optical element disposed at each of positions where the horizontal scan lines and the vertical scan lines intersect and selectively turned on based on the video signal and the vertical scan signal. Defect information indicating whether there is a defect or not is stored in a defect information storing section. A functional unit (defect information generating section) determining whether there is a defect or not may be incorporated in a display device, and the unit may alternatively be disposed outside the display device.

When each of the electro-optical elements is driven thereafter, a video signal is supplied to the electro-optical element based on a video signal supplied from outside and defect information stored in the defect information storing section. For an electro-optical element having a defect, the supply of a signal having a level required to turn the element on is stopped. For an electro-optical element having no defect, the externally supplied signal is generated by the video signal generating section.

In summary, when it is determined whether each of electro-optical elements disposed in the form of a matrix on a display panel has a defect or not, information identifying defective elements is stored, and a repair is carried out based on the information using a method which is electrical in that no drive signal is supplied to a defective element. The supply of a drive signal required for emission is stopped for a defective element emitting light out of a normal range. Thus, the element becomes a dark dot, and a repair (recovery process) is completed.

According to the embodiment, a recovery process can be carried out on a defective element emitting light out of a normal range using an electrical method instead of a repairing method involving a rework, and the non defect ratio of display devices can be thereby improved. Further, problems caused by supplying a drive signal to a defective element can be eliminated.

Additional features and advantages are described herein, and will be apparent from the following Detailed Description and the figures.

BRIEF DESCRIPTION OF THE FIGURES

FIG. 1 is a block diagram schematically showing a first embodiment of a display device according to the invention;

DETAILED DESCRIPTION

Figure 2A:
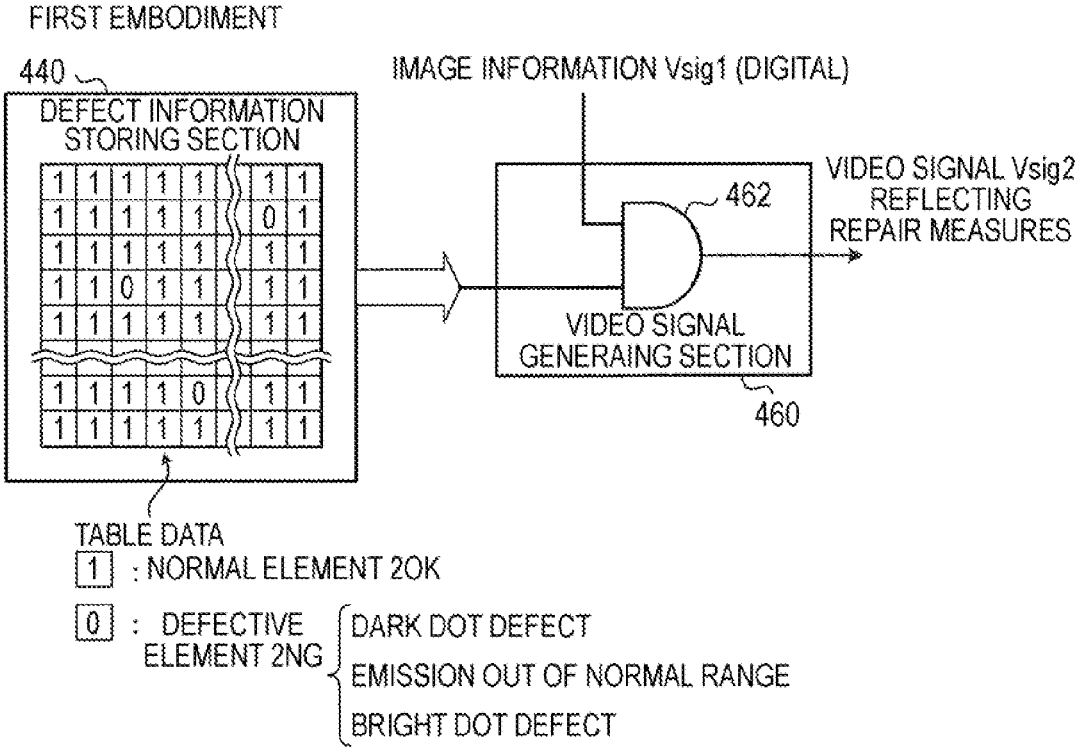
FIGS. 2A and 2B are illustrations and diagrams for explaining exemplary configurations of a video signal generating unit.

Embodiments will now be described with reference to the drawings. Different versions of each functional element according to the invention used in the embodiments will be distinguished from each other by reference numerals having English suffixes in capital letters, e.g., A, B, and so on. When a general description is made on a functional element without any particular distinction between different versions of the element, the element will be indicated without such a suffix. This holds true for the description of the drawings.

The embodiments described below are examples in which LED elements are used as display elements (electro-optical elements or light emitting elements) disposed at pixels. Although LED elements will be specifically described below as an example of display elements disposed at pixels, the description merely shows an example, and display elements that the invention can be embodied are not limited to LED elements. Although the LED elements will be described as cathode line scan/anode line drive type elements which are turned on by supplying a video signal to an anode end thereof. However, the description merely shows an example, and the LED elements may be anode line scan/cathode line drive type elements which are turned on by supplying a video signal to a cathode end thereof.

First Embodiment

FIG. 1 is a block diagram schematically showing a first embodiment of a display device according to the invention. The first embodiment has a configuration in which a functional unit for detecting fundamental information contributing to determination of a defect and a functional unit for generating defective element data are provided outside a display device 1A. That is, the configuration is adapted to jigs.

As shown in FIG. 1, the display device 1A of the first embodiment includes a display panel unit 100 having a plurality of LED elements 2 as display elements disposed to form an effective image area having a display aspect ratio X:Y (e.g., 9:16), a drive signal generating unit 200 that is an example of a panel control unit generating various signals for driving and controlling the LED elements 2 of the display panel unit 100, and a video signal processing unit 300. The drive signal generating unit 200 and the video signal processing unit 300 are incorporated in a single-chip IC (integrated circuit).

The display device 1A is not limited to the form of a module (composite component) including all of the display panel unit 100, the drive signal generating unit 200, and the video signal processing unit 300 as illustrated, and the display device 1A may be provided as a product including only, for example, the display panel unit 100. Such a display unit 1A may be used as a display section of portable music players or electronic apparatus of other types utilizing recording media such as semiconductor memories, mini discs (MDs), and cassette tapes.

The display panel unit 100 includes a vertical driving section (also referred to as "row driving section") 103 scanning the LED elements 2 in the vertical direction, a horizontal driving section (also referred to as "column driving section", "horizontal selector", or "data line driving section") 106 scanning the LED elements 2 in the horizontal direction, and a terminal section (pad section) 108 for external connections, which are integrally formed on a substrate. Further, the display panel unit 100 is formed by electrically connecting a pixel array section 102 having an array of the LED pixels 2 in the form of a matrix with n rows and m columns and peripheral driving circuits such as a vertical driving section 103 and a horizontal driving section 106 using connection wirings such as flexible cables.

For example, the pixel array section 102 is driven by the vertical driving section 103 from one side or both sides thereof in the horizontal direction of FIG. 1, and the section is driven by the horizontal driving section 106 from one side or both sides thereof in the vertical direction of FIG. 1.

The LED elements 2 may be driven in either the passive matrix mode in which the LED elements 2 are simply arranged in the form of a matrix or the active matrix mode in which each of the LED elements 2 arranged in the form of a matrix is turned on by a TFT (thin film transistor). The elements will be described below as active matrix type elements.

Row scan lines (cathode lines) 103VS and video signal lines (data lines or anode lines) 106HS are formed at the pixel array section 102. The LED elements 2 are disposed at intersections between the two types of lines as indicated by symbol marks for diodes to form the pixel array section 102. Row scan lines 103VS_1 to 103VS_n driven by row selection signals from the vertical driving section 103 are provided for n respective rows of pixels formed by the LED elements 2, and m video signal lines 106HS_1 to 106HS_m driven by video signals (particularly, video signals Vsig2 reflecting repair measures in the present embodiment) from the horizontal driving section 106 are provided for m respective columns of pixels.

The vertical driving section 103 sequentially selects cathodes of the LED elements 2 through the row scan lines 103VS based on pulse signals for vertical driving supplied from the drive signal generating unit 200. The horizontal driving section 106 supplies a predetermined electric potential (an electric potential within an effective video range) among the video signals Vsig2 reflecting repair measures, which are signals for horizontal driving supplied from the driving signal generating unit 200, to anodes of selected LED elements 2.

It is assumed that the display device 1A of the present embodiment employs line sequential driving by way of example. The vertical driving section 103 scans the pixel array section 102 in a line sequential manner (or one row after another). In synchronism with this operation, the horizontal driving section 106 simultaneously supplies image signals for one horizontal line to the pixel array section 102. Dot sequential driving may be employed for the horizontal driving section 106 to sequentially and selectively supply the video signals Vsig2 reflecting repair measures to one column after another.

The horizontal driving section 106 includes a constant current source (not shown) which is operated using a driving voltage generated by a boosting circuit constituted by, for example, a DC-DC converter and column-side drivers 106*a* which are respectively connected to the video signal lines 106HS. The section operates to supply a current from the constant current source to the anode of each of the LED elements 2 disposed in association with the video signal lines 106HS through the respective column-side driver 106*a*. When each of the LED elements 2 is not supplied with the current from the constant current source by the column-side driver 106*a*, the video signal line 106HS is connected to a ground potential. The column-side drivers 106*a* are drivers which perform PWM modulation of a video signal to output a constant current to the pixel array section 102. Preferably, the column-side drivers 106*a* provided in association with the respective columns are contained in an IC in their entirety or in groups each supporting several columns.

Row-side drivers 103*a* respectively connected with the row scan lines 103VS are provided at the vertical driving section 103. The section operates to supply a reference potential point (ground potential) or a reverse bias voltage VM for preventing crosstalk-emission to the cathode of each of the LED elements 2 disposed in association with the row scan lines 103VS through the respective row-side driver 103*a*. The row-side drivers 103*a* are drivers which sink a current in synchronism with a scan signal. Preferably, the row-side drivers 103*a* provided in association with the respective rows are contained in an IC in their entirety or in groups each supporting several rows.

In such a configuration, the constant current source is connected to desired video signal lines 106HS with the row scan lines 103VS set at the reference potential point on a predetermined cycle. Thus, each of the LED elements 2 is selectively made to emit light. The vertical driving section 103 and the horizontal driving section 106 operate under control exercised by the drive signal generating section 200 and the video signal processing section 300, and each of the sections operates based on video signals to be displayed. Consequently, the constant current source is connected to desired video signal lines 106HS with the row scan lines 103VS set at the reference potential point on a predetermined cycle based on the video signals. Thus, each of the LED elements 2 is selectively made to emit light to display an image on the display panel unit 100 based on the video signals.

The display device 1A further includes a failure detecting mechanism for detecting a display failure at the display panel unit 100 (specifically, the pixel array section 102) and storage means for storing repair data based on results of the failure detection, the detection mechanism and the storage means collectively constituting a repair mechanism. The "repair data" is an example of defect information indicating whether each LED element 2 has a defect or not. For example, binary data indicating whether each LED element 2 has a defect or not in association with the position of each of the LED elements 2 is stored as table data (see FIGS. 2A and 2B). The failure detecting mechanism is connected to jigs for analyzing data and generating repair data provided outside the display panel unit 100. Repair data is registered in the storage means from the jigs for analyzing data analysis and generating repair data. These repair mechanism is explained as follows.

The display panel unit 100 includes a defect information accepting section 420, a defect information storing section (repair data storing section) 440, and a video signal generating section (video data calculating section) 460. The defect information accepting section 420 accepts input of repair data that is information indicating whether each LED element 2 has a defect or not from outside. The repair data obtained from outside through the defect information accepting section 420 is stored in the defect information storing section 440. The video signal generating section 460 generates a video signal Vsig2 reflecting repair measures for driving each LED element 2 based on image information Vsig1 supplied from outside and the repair data stored in the defect information storing section 440.

A defect determination information detecting section 500, a bright dot defect determining section 540, and a defect information generating section (repair data generating section) 600A are provided as production jigs around the display device 1A. The defect determination information detecting section 500 detects fundamental information contributing to determination of the presence of a defect at each LED element 2. The defect information generating section 600A accepts measurement data detected by the defect determination information detecting section 500. The defect information generating section 600A also accepts bright dot defect information indicating whether an LED element 2 is emitting light with high brightness out of a normal range from the bright dot defect determining section 540. The defect information generating section 600A generates repair data based on various types of information obtained by the defect determination information detecting section 500 and the bright dot defect determining section 540 and stores the data in the defect information storing section 440.

Referring to the configuration of the defect determination information detecting section 500, what is desirable is that the section detects terminal voltages at the anode end and the cathode end of an LED element 2 or voltages across the terminals in an operating state of the LED element 2 (a state in which a drive current enabling emission of light is passed through the element) and a non-operating state of the element as "fundamental information contributing to determination of the presence of a defect". Various types of known elements may be used as long as the requirement is met. A terminal voltage may be measured using a method employing a production jig such as a test fixture similar to methods used at common production sites.

The defect determination information detecting section 500 of the present embodiment includes an element characteristics acquiring portion 520 which acquires current-voltage characteristics of each LED element 2 of the pixel array section 102 serving as fundamental information for detecting any failure of the LED element 2 by measuring the voltage across the terminals of the LED element 2 when a predetermined current is supplied to the LED element 2. That is, the present embodiment employs a scheme for acquiring current-voltage characteristics (I-V characteristics) of an LED element 2 that is on, as measurement data. The element characteristics acquiring portion 520 provides the measurement data acquired for determining the presence of a defect to the defect information generating section 600A. The use of such a scheme allows the element characteristics acquiring portion 520 to acquire fundamental information to be used for determining a defect while an emission driving operation is in progress.

In the defect information storing section 440, at least the row position and the column position that an improperly emitting LED element 2 (referred to as "defective element 2NG") occupies in the pixel array section 102 are stored. A defective element 2NG may be an element constituting a dark dot which is not turned on at all even when a video signal Vsig is supplied as a drive signal, an element constituting an abnormal emitting dot which is turned on when a video signal Vsig is supplied but whose current-voltage characteristics are out of a normal range, or an element having a bright dot defect. It is not essential to store the row position and the column position that a properly emitting LED element 2 (referred to as "normal element 2OK") occupies in the pixel array section 102. However, in consideration to a display driving operation performed after the detection of defects, it is preferable to record information identifying each LED element 2 as a defective element 2NG or a normal element 2OK in association with the address of the element.

Based on image information Vsig1 supplied from the video signal processing unit 300 and repair data stored in the defect information storing section 400, the video signal generating section 460 converts image information Vsig1 for an LED element 2 to be repaired into zero (black level) and keeps the level of image information Vsig1 input for an LED element 2 requiring no repair as it is. The section transmits the resultant levels to the respective column-side drivers 106*a* as video signals Vsig2 reflecting repair measures.

The bright dot defect determining section 540 images the pixel array section 102 of the display panel unit 100 using, for example, a camera and analyzes the imaged data to detect bright dot defects, i.e., emission of light with undesirably high brightness. An LED element 2 having a bright dot defect is referred to as "bright dot defect element". For example, at each operation of the element characteristics acquiring portion 520 for acquiring current-voltage characteristics of each of the LED elements 2 by switching row and column addresses to cause the elements to emit light one after another, the bright dot defect determining section 540 determines whether the LED element 2 under measurement constitutes a bright dot or not by determining whether the brightness of light emitted by the element exceeds a predetermined threshold or not. In this instance, it is assumed that an element is determined to be a bright dot when the threshold is exceeded. The bright dot defect determining section 540 identifies the position (address) of a pixel having a bright dot defect and supplies the address information to the defect information generating section 600A.

The position of a pixel having a bright dot defect may alternatively identified by the defect information generating section 600A. In this case, the bright dot defect determining section 540 notifies the defect information generating section (repair data generating section) 600A of results of bright dot determination. The defect information generating section 600A accepts the input of the results of determination made by the bright dot defect determining section 540 on whether LED elements 2 under measurement have a bright dot defect or not to identify the position (address) of any pixel having a bright dot defect.

A system configuration excluding the bight dot defect determining section 540 may alternatively be employed. In this case, the function of the section may be executed by an operator for a product on a production line or a service engineer or user for a product which has been shipped. For example, at each operation of the element characteristics acquiring portion 520 for acquiring current-voltage characteristics of each of the LED elements 2 by switching row and column addresses to cause the elements to emit light one after another, an operator, a service engineer, or a user may identify the position (address) of a pixel having a bright dot defect and may input the address information to the defect information generating section 600A. The position of a pixel having a bright dot defect may alternatively be identified by the defect information generating section 600A. In this case, the defect information generating section 600A accepts input of results of manual determination on whether LED elements 2 under measurement have a bright dot defect or not to identify the position (address) of any pixel having a bright dot defect.

The defect information generating section 600A generates repair data based on measurement data provided by the element characteristics acquiring portion 520 and information on pixels constituting bright dots provided by the bright dot defect determining section 540. Specifically, the section refers to the measurement data provided by the element characteristics acquiring section 520 to compare actual current-voltage characteristics (I-V characteristics) of each LED element 2 with preset reference current-voltage characteristics (I-V characteristics), thereby detecting any display failure or determining whether there is a defect or not.

In summary, current-voltage characteristics of all LED elements 2 in the display panel section 100 are measured in advance. It is determined whether the LED elements 2 are being properly driven or not from the measured values to create a data table (repair data) on which the execution of a repair is instructed for a defective element. A signal level supplied to an LED element 2 to be repaired is converted into zero (black level) based on a video signal input from outside and the repair data, and the resultant level is input to the column-side driver 106*a* to drive the LED element 2 with a current. As a result, no current flows through the defective element, and the element becomes a dark dot. Thus, a repair is completed.

Since it can be easily determined whether each LED element 2 is being driven in a proper state or whether the element has a failure such as an open- or short-circuit from the current-voltage characteristics (I-V characteristics) of the LED element 2, repair data can be easily generated. When it is determined that an LED element 2 has a bright dot defect, the determination can be immediately reflected in repair data by checking the column and row addresses of the LED element 2. As thus described, the present embodiment employs a scheme allowing determination to be made by the bright dot defect determining section 540 or to be made manually not only on defects which can be determined from current-voltage characteristics (I-V characteristics) but also on bright dot defects which cannot be determined from current-voltage characteristics (I-V characteristics). Therefore, measures can be taken against defective elements of any type.

What is desirable for the defect information generating section 600A is that the section can execute various types of data analysis. Typically, it is preferable to use a scheme for electronic computers such as personal computers utilizing a microprocessor. When a scheme for electronic computers is used, the scheme will involve various units including a CPU (central processing unit), a ROM (read only memory) which is a storage unit used for readout only, a RAM (random access memory) which can be randomly written and read and which is an exemplary volatile storage unit, and an NVRAM which is an exemplary non-volatile storage unit. According to the scheme, most of the processes at the section will be executed on a software basis. For example, a program dedicated for the generation of repair data is incorporated in a personal computer to generate repair data by referring to measurement data and identifying the column and row addresses of elements having a bright dot defect, and the data is written into the defect information storing section 440 from the personal computer.

Referring to specific means used at various units (including functional blocks) for executing the series of processes, arbitrary means may be used including hardware, software, combinations of hardware and software, and combinations of those means with networks, which will be apparent to those skilled in the art. Functional blocks may be combined with each other to form one functional block.

When the processes are executed on a software basis, a program including a record of a processing sequence may be executed by installing it in a memory of a computer incorporated in dedicated hardware. The program may alternatively be executed by installing it in a general-purpose computer on which various processes can be executed. The various processes may be executed not only in a time-sequential manner according to the following description of the embodiment but also in parallel or independently of each other depending on the processing capabilities and requirements of the devices executing the processes.

At the pixel array section 102 having the LED elements 2 serving as light-emitting elements whose electrodes are formed in a matrix, the element characteristics acquiring portion 520 measures a voltage (VF value) generated across each LED element 2 when a constant current is passed therethrough, the measurement being performed on all of the elements in advance. Results of the measurement are supplied to the defect information generating section 600A, and the defect information generating section 600A prepares a data file from the results. Each of the LED elements 2 of the pixel array section 102 is checked by the bright dot defect determining section 540, an operator, a service engineer, or a user to detect a bright dot defect or emission of light with undesirably high brightness which may occur when the element 2 is actually turned on. When an LED element 2 has a bright dot defect, the addresses that the element occupies in the row direction and the column direction of the pixel array section 102 are recorded.

When an LED element 2 is being properly driven, it has a voltage within the tolerance for variation of the VF value. When no current flows through an LED element 2 due to a failure of the electrode or the like, an open-circuit failure occurs, and the element has a voltage value near the circuit voltage of the constant current circuit used for the measurement. When an LED element 2 or the electrode thereof has a shorting failure, the element has a voltage value near 0 V which is far away from the normal range.

The defect information generating section 600A determines whether the measured voltages of the LED elements 2 are within the proper range of the VF value. An LED element 2 out of the range is regarded as an element to be repaired. An LED element 2 within the proper range is regarded as an element requiring no repair. An element having a bright dot defect is also regarded as an element to be repaired. An element to be repaired is referred to as "defective element 2NG", and an element requiring no repair is referred to as "normal element 20K".

A data table (repair data) specifying whether a repair is required or not as described above for every LED element 2 of the pixel array section 102 using binary data (0 and 1 or L and H) is generated. The data is written in advance in the defect information storing section 440 serving as a memory for repair data through an interface. For example, "0" is written for a defective element 2NG, and "1" is written for a normal element 2OK.

The repair data may be generated by inputting the measurement data file and the addresses of elements having a bright dot defect to the defect information generating section 600A which has a dedicated program incorporated therein in advance (a personal computer is used).

When the pixels are actually driven (or when an image is displayed) after the defect determination, a defective element 2NG is repaired using a method in which the repair data and video data are synthesized to disable pixel driving for the defective element 2NG (or to pass no drive current through the element) to render the element as a dark dot intentionally.

For example, image information Vsig1 is supplied from the drive signal generating unit 200 to the video signal generating section 460. The video signal generating section 460 reads repair data associated with an LED element 2 of interest from the defect information storing section 440 to perform information processing between the repair data and the image information Vsig1. When the repair data is "0", the element is a defective element 2NG. Then, the video signal generating section 460 converts the level of the video signal for the LED element 2 to be repaired into zero (black level) and sends the resultant level to the column-side driver 106*a*. When the repair data is "1", the element is a normal element 2OK. Then, the video signal generating section 460 sends the image information Vsig1 input for the LED element 2 requiring no repair to the column-side driver 106*a* without changing the level of the same. A video signal reflecting a need or no need for a repair and supplied to a column-side driver 106*a* as thus described is referred to as "video signal Vsig2 reflecting repair measures".

A column-side driver 106*a* performs PWM modulation of a repaired video signal Vsig2 to output a constant current. When the level of the video signal Vsig2 reflecting repair measures is zero, the driver outputs no current, and no current therefore flows through the defective element 2NG to be repaired. A row side driver 103*a* performs an operation of sinking a current output from a column-side driver 106*a* in synchronism with a scan signal.

As thus described, the scheme for repairing a defective element in the present embodiment employs a repairing technique according to a method in which no drive current is passed through a defective element. Thus, all effective elements are rendered as dark points which are not turned on.

According to the scheme, problems attributable to an open-circuit failure can be prevented, including current charging at floating capacities of properly operating elements and wirings connected to the same column as the failed element, instantaneous emission resulting from the charging, and the application of an overvoltage attributable to a voltage increase that follows the current charging. Thus, the scheme provides solutions to problems which cannot be solved by physical means such as cutting (breaking) a wiring or electrode using a laser beam or removing an element.

In the case of a short-circuit failure, the supply of the drive current is stopped, and unnecessary output of a current is therefore prevented. Thus, loads on the drivers (the row-side drivers 103*a* and the column-side drivers 106*a*) are reduced.

Since no drive current is passed through a defective element according to the method, there is no need for reworking such as breaking an electrode inside a display panel or removing an element, and a significant reduction can be therefore achieved in man-hour required for a repair. Since the method does not include the step of actually processing a display panel using a laser beam, no failure attributable to an erroneous repair will occur.

The above-described series of processes can be repeated and regularly or irregularly, and the processes can be executed at arbitrary time through external operations. Repair can be carried out any number of times by correcting repair data. Therefore, proper measures can be taken not only during repair operations at a production site but also against defects which are newly encountered after products are shipped to the market.

In the first embodiment, both of the defect determination information detecting section 500 and the defect information generating section 600A are disposed outside the display panel unit 100 and are treated as jigs used at a production site, which is advantageous in that the exclusion of those sections allows the size and cost of the display device 1 to be reduced accordingly.

[Exemplary Configuration of Video Signal Generating Section]

Figure 2B:
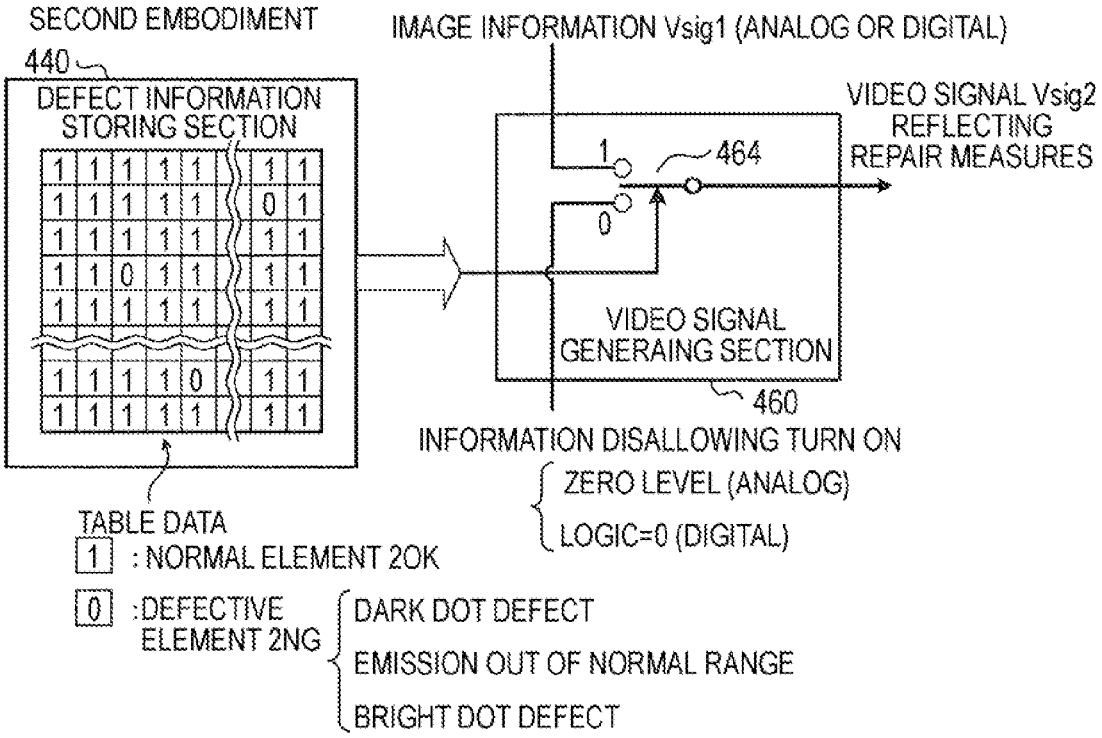

FIGS. 2A and 2B are illustrations and diagrams showing exemplary configurations of the video signal generating section 460. For example, when the image information Vsig1 is digital data, the video signal generating section 460 may be provided with a configuration as represented by the first example shown in FIG. 2A in which a logic unit (an AND gate 462 in this case) is provided to generate a video signal to be supplied to the LED element 2 in a respective position by performing an AND operation. The video signal generating section 460 can easily generate a video signal Vsig2 reflecting repair measures by performing a logical operation (which may be an AND operation in this case) between the image information Vsig1 and repair data stored as binary data in the data table of the defect information storing section 440.

When the image information Vsig1 is analog data, the video signal generating section 460 may be provided with a configuration as represented by the second example shown in FIG. 2B in which a 2-input/1-output analog switch 464 is provided as an example of a signal selection unit. The analog information Vsig1 is supplied to one of the input ends (first input end) of the analog switch 464, and information (e.g., zero level) disallowing an LED element 2 to be turned on is supplied to the other input end (second input end), the output end of the switch being connected to a column-side driver 106*a*. Repair data is supplied from the defect information storing section 440 to a control input end of the analog switch 464. The analog switch 464 selects the zero level at the second input end when the repair data is "0" and selects the image information Vsig1 at the first input end when the repair data is "1". Thus, a video signal Vsig2 reflecting repair measures can be easily generated just as in the case of digital information.

An AND gate 462 or analog switch 464 is provided in association with each group of the video signal lines 106HS corresponding to one row to accommodate line sequential driving, and the gate or analog switch is provided in association with each video signal line 106HS to accommodate dot sequential driving.

The configuration of the second example can be used when the image information Vsig1 is digital data by replacing the analog switches 464 with 2-input/1-output data selectors. Such data selectors are also an example of signal selection units. In this case, information of logic "0" may be supplied instead of the zero level.

Second Embodiment

Figure 3:
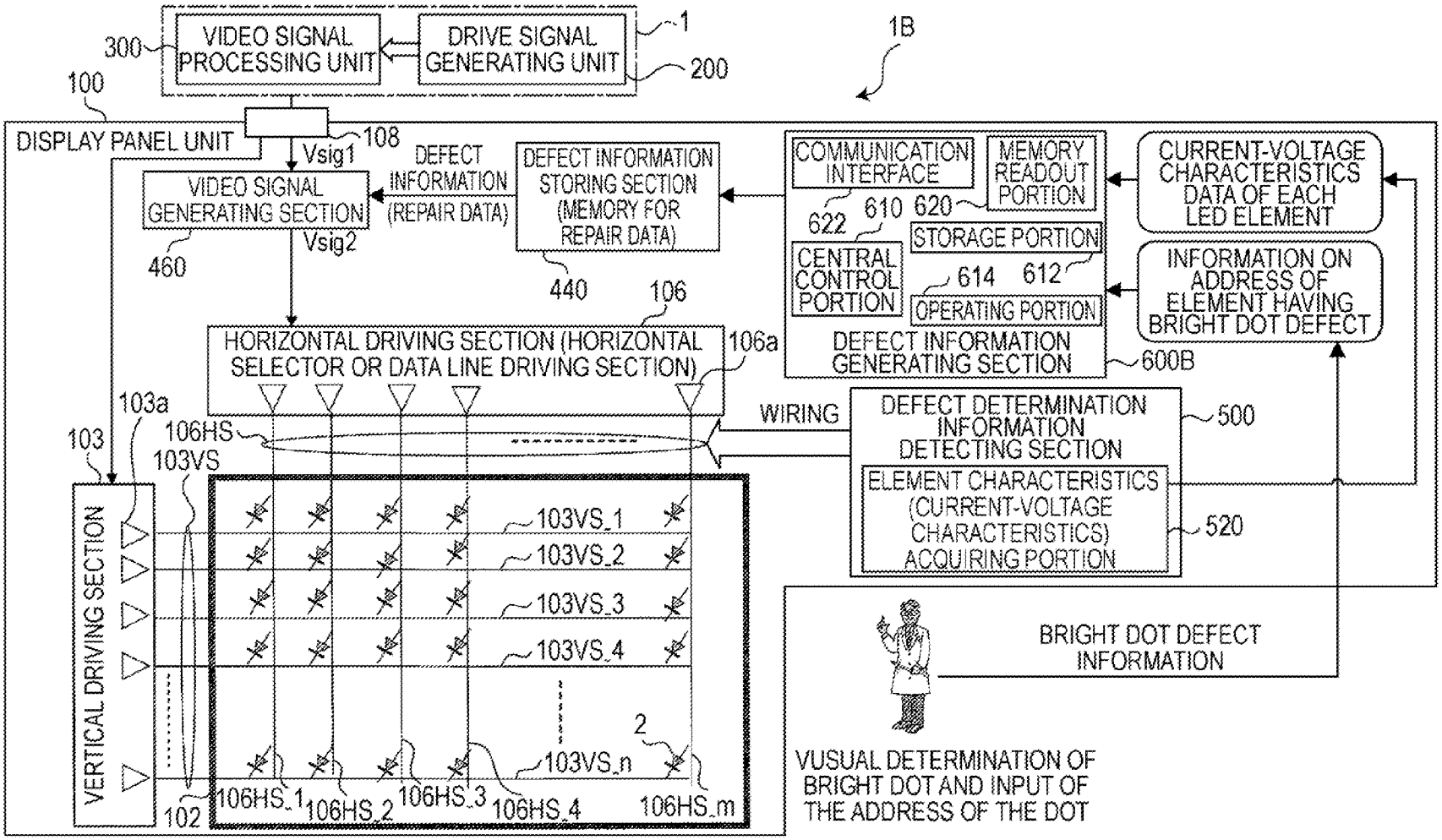
FIG. 3 is a block diagram schematically showing a second embodiment of a display device according to the invention.

FIG. 3 is a block diagram schematically showing a second embodiment of a display device according to the invention. The second embodiment has a configuration in which a functional unit for detecting fundamental information contributing to determination of a defect and a functional unit for generating defective element data are also incorporated in a display panel unit 100.

The embodiment is significantly different from the display device 1A of the first embodiment in that a defect determination information detecting section 500 and a defect information generating section 600B are incorporated in a display panel unit 100 and in that it does not include a defect information accepting section 420 and a bright dot defect determining section 540. The section 540 is excluded to accommodate applications commonly seen on the market. The embodiment is configured to accept only manual input of information identifying an LED element 2 having a bright dot defect. The second embodiment may alternatively have a configuration in which a bright dot defect determining section 540 is provided outside the display device 1B.

In order to implement such a scheme, in the display panel unit 100 of the second embodiment, wirings for measuring terminal voltages of LED elements 2 are routed from at least either row scan lines 103VS or video signal lines 106HS to the defect determination information detecting section 500. Since the present embodiment employs the cathode line scan/anode line drive method, it may be considered that the value of a potential at the cathode end of an LED element 2, i.e., a potential at an output end of a row-side driver 103*a* associated therewith is known (for example, substantially zero) when the element is driven. A potential across the LED element 2 can be identified by measuring a potential at a video signal line 106HS connected to the anode end of the LED element 2, and the value of the drive current at that time is known because a horizontal driving section 106 uses a PWM/constant current output driving method. Consequently, current-voltage characteristics of the LED element 2 can be identified by measuring the potential at the video signal line 106HS.

Although not shown, in an exemplary configuration employing the anode line scan/cathode line drive method, it may be considered that the value of a potential at the anode end of an LED element 2, i.e., a potential at an output end of a column-side driver 106*a* associated therewith is known (for example, substantially equal to a power supply voltage level) when the element is driven. A potential across the LED element 2 can be identified by measuring a potential at a row scan line 103VS connected to the cathode end of the LED element 2, and the value of the drive current at that time is known because a vertical driving section 103 uses a PWM/constant current output driving method. Consequently, current-voltage characteristics of the LED element 2 can be identified by measuring the potential at the row scan line 103VS.

In either case, since problems may occur in wiring the row scan line 103VS or video signal line 106HS to the defect determination information detecting section 500, it is preferable to employ a configuration in which functional units of the defect determination information detecting section 500 are contained a vertical driving section 103 or a horizontal driving section 106.

The defect information generating section 600B of the display device 1B of the second embodiment includes a central control portion 610 constituted by a CPU (central processing unit) or a microprocessor, a storage portion 612 having a ROM (read only memory) which is a storage unit used for readout only, a RAM (random access memory) which is a randomly readable and writable memory, or the like, an operating portion 614, and other peripheral members which are omitted in the drawing.

The central control portion 610 is similar to units serving as the hearts of electronic computers represented by CPUs which are very small integrated circuits obtained by integrating calculation and control functions of computers (microcomputers). A control program and the like for the defect information generating section 600B are stored in the ROM. The ROM of the storage portion 612 may have the function of a defect information storing section 440. The operating portion 614 is a user interface for accepting operations performed by a service engineer or a common user.

The defect information generating section 600B of the second embodiment has the function of generating repair data similar to that of the defect information generating section 600A of the first embodiment. As far as this function is concerned, the defect information generating section 600B takes steps similar to those in the first embodiment. Specifically, the section acquires measurement data from an element characteristics acquiring portion 520, accepts input of results of bright dot determination from a service engineer or a common user through the operating portion 614, generates repair data based on them, and registers the data in a defect information storing section 440.

Referring to the control system of the display device 1B, a configuration to allow insertion and removal of an external recording medium such as a memory card, which is not shown, may be employed. Alternatively, a configuration to allow the device to be connected to a communication network such as internet may be employed. The control system includes a memory readout portion 620 for reading information from a portable recording medium and a communication interface 622 serving as interface means for external communication, in addition to the defect information generating section 600B (the central control portion 610 and the storage portion 612). The provision of the memory readout portion 620 allows a program to be installed and updated in the defect information generating section 600B using an external recording medium. The provision of the communication interface 622 allows a program to be installed and updated through a communication network.

The embodiment employs a repairing scheme basically similar to that of the first embodiment, and advantages similar to those of the first embodiment can be achieved. Since the defect determination information detecting section 500 (element characteristics acquiring portion 520) and the defect information generating section 600 are formed integrally with the display device 1 (display panel unit 100), the embodiment is a preferable example of a configuration to allow even defects newly encountered after the shipment of products to the market to be easily repaired.

While the invention has been described above using embodiments of the same, the technical scope is not limited to the above description of the embodiments. The above-described embodiments may be modified or improved in various ways without departing from the spirit, and such a modified or improved mode of implementation is included in the technical scope.

The above-described embodiments do not constitute any limitation on the claimed invention, and it is not necessarily essential that the solving means disclosed by the invention include all combinations of the features described in the embodiments. The above-described embodiments include various phases, and various aspects can be extracted by combining the plurality of constituent features disclosed in appropriate manners. Even when some of the constituent features disclosed in the embodiments are deleted, the resultant configuration excluding those constituent features can be still extracted as an aspect as long as the advantageous can be achieved.

While the LED elements 2 have been described as exemplary self-emitting elements serving as electro-optical elements in the above embodiments, other types of current-driven self-emitting elements such as organic EL elements may be used instead of the LED elements 2.

Either of the defect determination information detecting section 500 and the defect information generating section 600 may be incorporated in the display panel unit 100 to provide a configuration intermediate between the configurations of the first and second embodiments.

The bright dot defect determining section 540 may employ a scheme not only for determining a bright dot defect but also for determining another type of defect based on whether an element of interest is out of a normal range or not. That is, the bright dot defect determining section 540 may also have the function of the defect determination information detecting section 500.

The defect determination detecting section 500 is not limited to the use of the element characteristics acquiring portion 520, and the section may employ a scheme in which a reverse bias voltage is applied to the cathode of an LED element 2 in a non-emitting state to measure a potential at the anode end in the same state, as disclosed in Patent Document 2. In this case, the defect information generating section 600 may determine whether the LED element 2 has a defect or not by comparing the potential at the anode end when the reverse bias is applied with a predetermined threshold to determine whether the potential is within a normal range or not.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A display device comprising:

horizontal scan lines disposed in parallel in the column direction of a matrix to supply a video signal;

vertical scan lines disposed in parallel in the row direction of the matrix to supply a vertical scan signal;

an electro-optical element disposed at each of positions where the horizontal scan lines and the vertical scan lines intersect and selectively turned on based on the video signal and the vertical scan signal;

a defect information storing section that stores defect information indicating whether each of the electro-optical elements has a defect or not;

a video signal generating section that generates the video signal to be supplied to the electro-optical element in each position based on an outside video signal supplied from outside and the defect information stored in the defect information storing section and;

a defect information accepting section that accepts the defect information from a defect information generating section that generates the defect information provided externally, wherein the defect information obtained from the defect information generating section through the defect information accepting section is stored in the defect information storing section, wherein the defect information accepting section accepts bright dot defect information from a bright dot defect determining section provided externally for determining whether the electro-optical elements are emitting light with high brightness out of the normal range or not, wherein the video signal generating section supplies the video signal to the electro-optical elements, wherein the video signal supplied to the electro-optical element having at least one of the defect information and the bright dot defect information is set to a black level, and wherein the video signal supplied to the electro-optical element having no defect is set to a level of the outside video signal.

2. The display device according to claim 1, further comprising a defect determination information detecting section that detects information contributing to determination of whether each of the electro-optical elements has a defect or not.

3. The display device according to claim 2, wherein the defect determination information detecting section includes an element characteristics acquiring portion for acquiring current-voltage characteristics of the electro-optical elements as information contributing to determination of the presence of a defect.

4. The display device according to claim 1, wherein information indicating the presence of a defect is stored in the defect information storing section for any of the electro-optical elements emitting light with high brightness out of a normal range regardless of whether the current-voltage characteristics of the electro-optical element are proper or not.

5. The display device according to claim 1, further comprising a defect information generating section that generates the defect information and storing it in the defect information storing section.

6. The display device according to claim 1, wherein the defect information accepting section accepts bright dot defect information based on manual determination on whether the electro-optical elements are emitting light with high brightness out of the normal range or not.

7. The display device according to claim 1, wherein:

binary data indicating whether each of the electro-optical elements has a defect or not is stored as table data in the defect information storing section in association with the position where each of the electro-optical elements is disposed; and the video signal generating section includes a logic unit for generating a video signal to be supplied to the electro-optical element in each position by performing a logical operation between the outside video signal, which is a digital signal, supplied from outside and the binary data indicating whether there is a defect or not in the form of table data read out from the defect information storing section.

8. The display device according to claim 1, wherein:

binary data indicating whether each of the electro-optical elements has a defect or not is stored as table data in the defect information storing section in association with the position where each of the electro-optical elements is disposed; and the video signal generating section includes a signal selecting portion which receives input of the outside video signal supplied from outside at one input end thereof, which is supplied with information disallowing the electro-optical element to be turned on at another end thereof, and which is supplied with the binary data indicating whether there is a defect or not in the form of table data read out from the defect information storing section at a control input end thereof, the signal selecting portion selecting and outputting a video signal to be supplied to the electro-optical element in each position.

9. The display device according to claim 1, wherein the video signal generating section supplies the video signal to the electro-optical elements such that no drive current is passed through the electro-optical element having the defect.

10. The display device according to claim 1, wherein the black level for the electro-optical element having a defect is substantially zero.

11. A method of driving a display device comprising:

determining whether there is a defect at each of electro-optical elements of a display panel unit including horizontal scan lines disposed in parallel in the column direction of a matrix to supply a video signal, vertical scan lines disposed in parallel in the row direction of the matrix to supply a vertical scan signal, and the electro-optical element disposed at each of positions where the horizontal scan lines and the vertical scan lines intersect and selectively turned on based on the video signal and the vertical scan signal;

storing defect information indicating whether there is a defect or not in a defect information storing section;

supplying, by a video signal generating section, the video signal to the electro-optical elements based on an outside video signal supplied from outside and the defect information stored in the defect information storing section; and accepting, from a defect information accepting section the defect information from a defect information generating section that generates the defect information provided externally, wherein the defect information obtained from the defect information generating section through the defect information accepting section is stored in the defect information storing section, wherein the defect information accepting section accepts bright dot defect information from a bright dot defect determining section provided externally for determining whether the electro-optical elements are emitting light with high brightness out of the normal range or not, wherein the video signal supplied to the electro-optical element having at least one of the defect information and the bright dot defect information is set to a black level, and wherein the video signal supplied to the electro-optical element having no defect is set to a level of the outside video signal.

12. The method according to claim 11, wherein the black level for the electro-optical element having a defect is substantially zero.

* * * * *